US006909040B1

(12) United States Patent
Fredrickson et al.

(10) Patent No.: US 6,909,040 B1
(45) Date of Patent: Jun. 21, 2005

(54) LOW COST MUSICAL QUALITY HAND DRUM

(75) Inventors: Roxanne Fredrickson, Castle Rock, CO (US); Todd Strandberg, Castle Rock, CO (US)

(73) Assignee: Roxy Rhythm, LLC, Castle Rock, CO (US)

( * ) Notice: Subject to any disclaimer, the term of this patent is extended or adjusted under 35 U.S.C. 154(b) by 7 days.

(21) Appl. No.: 10/448,563

(22) Filed: May 30, 2003

(51) Int. Cl.[7] ..... G10D 13/02

(52) U.S. Cl. ..... 84/411 R; 84/414; 84/416; 84/419; 84/420; 84/417

(58) Field of Search ..... 84/411 R, 414, 84/416, 419, 420, 417

(56) References Cited

U.S. PATENT DOCUMENTS

| | | | | | |
|---|---|---|---|---|---|
| 2,022,820 | A | * | 12/1935 | Parkinson et al. | 84/420 |
| 2,485,985 | A | | 10/1949 | Perry | 84/411 |
| 3,055,253 | A | * | 9/1962 | Loughborough | 84/411 R |
| 3,185,013 | A | | 5/1965 | Gussak | 84/411 |
| 3,680,425 | A | * | 8/1972 | Morena et al. | 84/411 R |
| 3,791,249 | A | | 2/1974 | Frigo et al. | 84/411 |
| D234,156 | S | | 1/1975 | Lane | D56/1 E |
| D242,875 | S | | 12/1976 | Clements et al. | D56/1 E |
| 4,173,917 | A | | 11/1979 | Della-Porta | 84/419 |
| 4,244,265 | A | | 1/1981 | Tuttrup | 84/411 |
| 4,549,462 | A | * | 10/1985 | Hartry et al. | 84/413 |
| 5,025,697 | A | * | 6/1991 | May | 84/411 R |
| 5,349,891 | A | | 9/1994 | Belli | 84/411 |
| 5,385,076 | A | | 1/1995 | Belli | 84/414 |
| 5,517,890 | A | * | 5/1996 | Cooperman | 84/411 R |
| 5,600,080 | A | | 2/1997 | Belli | 84/421 |
| D395,118 | S | | 6/1998 | Cramer et al. | D34/39 |
| 6,586,665 | B1 | * | 7/2003 | Liao et al. | 84/411 R |

* cited by examiner

*Primary Examiner*—Shih-Yung Hsieh
(74) *Attorney, Agent, or Firm*—Marsh Fischmann & Breyfogle LLP

(57) ABSTRACT

The present invention relates to a musician quality hand drum that may be produced in a simplified and economical manner. The hand drum is simplified in that it utilizes a ring interconnected within an open end of a simple tubular shell to allow a musical quality drumhead (e.g., an animal skin drumhead) to be interconnected in tension directly to the outside surface of the drum shell. In this regard, the need for an intricate, expensive drumhead fixation means and/or drumhead tensioners is eliminated, allowing for cost benefits to be realized.

31 Claims, 4 Drawing Sheets

LOW COST MUSICAL QUALITY HAND DRUM

FIELD OF THE INVENTION

The present invention generally relates to percussive musical instruments. In particular, the present invention relates to a musician quality hand drum that may be produced in a simplified and economical manner.

BACKGROUND

Percussive drums utilize a generally tubular shell having a tensioned membrane or "drumhead" interconnected over one or two open ends of the shell. The tensioned drumhead (s) in combination with a tubular shell, allows a drum to produce amplified percussive tones. Generally, musician quality drums utilize drumheads that are clamped under a rim on one end of the drum shell. Clamping screws attach to the rim and screw into threaded receptacles mounted on the side of the drum shell. When these screws are tightened, the rim tensions the drumhead securely across an open end of the drum shell. Typically, drums utilizing skin and synthetic drumheads utilize these cumbersome clamping means to secure the head to the drum shell as well as tension the drumhead.

If a drum shell does not have sufficient structural integrity when the drumhead is tensioned, the drum shell may be squeezed inwardly, becoming slightly elliptical. This may result in misaligning the bearing edge of the drum shell, which affects the tension maintained across the drumhead and may cause an undesired change in the percussive tone of the drum. In order to produce drum shells having adequate structural integrity to withstand drumhead tensioning and/or percussive forces applied to the drumhead, drum shells are commonly made of reinforced wood or composite laminate materials. In this regard, construction of the drum shell involves a considerable degree of mechanical skill and labor.

Drumheads range from crude, inexpensive structures such as paper or fabric stretched to very expensive drumheads that utilize natural animal skins or synthetic materials. Inexpensive paper or fabric heads are typically not capable of producing musician-quality tones for percussive drums. In contrast, synthetic drumheads and skin drumheads typically produce more sophisticated, resonant sound, particularly in the lower ranges, which musicians typically prefer. Furthermore, skin drumheads typically produce a warm tone having a fundamental note produced with minimal overtones. Additionally, sound decay in drums having a skin drumhead is relatively short, allowing each note of a musical composition to be articulated. In this regard, drums that utilize skin drumheads are well suited for student musicians. However, as a result of utilizing intricate tensioning/attachment means and complex drum shells, musician quality drums that utilize skin drumheads are relatively expensive. Accordingly, these drums are often prohibitively expensive for student musicians.

SUMMARY OF THE INVENTION

An object of the present invention is to provide a percussive musical instrument that is durable and inexpensive to produce.

Another object of the present invention is to produce a musician quality drum that utilizes a skin drumhead.

These and additional advantages are indeed realized by the present invention wherein a musical quality hand drum is provided having a simplified construction. The hand drum is simplified in that it utilizes a ring interconnected within an open end of a simplified drum shell to allow a musical quality drumhead (e.g., an animal skin drumhead) to be interconnected in tension directly to the outside surface of the drum shell. In this regard, the need for an intricate, expensive drumhead fixation means/tensioner is eliminated, allowing for cost benefits to be realized.

According to a first aspect of the present invention, a hand drum is provided that includes a tubular shell having at least a first open end. A sidewall of the tubular shell defines an inside surface and an outside surface of the drum. An annular reinforcing member is interconnected directly to the inside surface of the tubular shell and located substantially adjacent to the open end of the tubular shell. This annular reinforcing member increases the hoop strength of the tubular shell. As will be appreciated, this allows for simplified construction of the drum shell. Further, the increased hoop strength of the tubular shell allows a drumhead (e.g., a stretchable skin drumhead) to extend across the open end of the tubular shell and be directly interconnected to the outside surface of the tubular shell. That is, the drunhead may be stretched in tension across the open end of the drumhead and interconnected to the outside surface of the tubular shell without utilization of external fixation means. Preferably, there is a partial overlap (e.g. concentric) of the contact region between the annular reinforcing member and the tubular shell and the contact region between the drumhead and the outside surface of the tubular shell. In this regard, forces (e.g., tension and/or percussive forces) applied to the tubular shell by the drumhead may be supported at least in part by the annular reinforcing member.

As the annular reinforcing member increases the hoop strength of the tubular shell, the tubular shell does not by itself bear the forces applied by the drumhead. Accordingly, complex laminated or wood drum shells having high hoop strengths are not required. What is required is that the tubular shell be formed of a material that provides sufficient tonal qualities for the resulting drum. In this regard, the selected material is preferably continuously formed about its perimeter as well as being substantially continuous between first and second open ends. In this regard, the drum shell may be a one-piece unit that may better amplify vibrations of the drumhead. The selected shell material should also have a density sufficient to amplify the vibrations without unduly muffling the resulting sounds. In one embodiment, a cellulose fiber material (e.g. a dense cardboard) is utilized. In this regard, cellulose fiber shells having a wall thickness between about three-sixteenths of an inch and about one-inch have been found to provide good tonal qualities while being inexpensive to produce. Other materials that provide low cost drum shells having adequate tonal qualities include, plastics, clay and sheet metal.

The drum shell may come in any variety of sizes or shapes and may further include a second open end that may or may not be covered by a second drumhead. The sizes and shapes of the drum shell may be selected for tonal qualities of the resulting drum. For example, the drum shell may be substantially cylindrical, in which case the diameter of the cylindrical shell may be selected in accordance with the desired tone of the resulting drum. Likewise, the length of the sidewall of the tubular shell may also be selected for tonal qualities.

In order to enhance the hoop strength of the tubular shell, the annular member will typically be in a conformal relationship around the inside surface of the tubular shell. For example, when a tubular shell is substantially cylindrical, the inside diameter of the tubular shell and the outside diameter of the annular member may be substantially equal. In this regard, the tubular shell may be supported continuously about its perimeter. Typically, the hoop strength of the annular reinforcing member will be substantially greater than the hoop strength of the tubular shell.

In order to continuously extend about the inside perimeter of the tubular member, the annular reinforcing member may be formed as a single continuous ring. That is, the annular reinforcing member may comprise a unitary member forming a closed loop. Alternatively, the annular reinforcing member may comprise a non-continuous member that may be shaped substantially similar to the open end of the tubular shell. In one embodiment, a non-continuous member includes first and second free ends that allow for individually tailoring the non-continuous member to the shape of the inside surface of the tubular shell. For example, one or both ends of the non-continuous reinforcing member may be trimmed to allow for an improved fit between the tubular shell and the resulting annular member. In any case, the first and second free ends may be disposed in an abutting relationship when interconnected within the tubular shell. Accordingly, once in the abutting relationship inside the tubular shell, the hoop strength of the non-continuous reinforcing annular member may be substantially the same as a unitary annular member.

As noted, the reinforcing annular member is interconnected to the inside surface of the tubular shell. An end surface of the annular reinforcing member and an end surface of the tubular shell (i.e. the rim of the open end) may be substantially flush. Alternatively, the annular member may be slightly recessed relative to the end surface of the tubular shell such that the reinforcing ring does not interfere (e.g., contact) the drumhead when the drumhead is struck. To maintain its location within the open end of the tubular shell, the annular reinforcing member is fixedly interconnected to the inside surface of the tubular shell. In this regard, mechanical fasteners may be utilized to affix the annular reinforcing member to the sidewall of the tubular shell. That is, mechanical fasteners such as screws, tacks, etc. may be spaced about the perimeter of the annular reinforcing member. Alternatively, the annular reinforcing member may be continuously interconnected to the inside surface of the tubular shell. For example, the annular reinforcing ring may be adhered around the inside surface of the tubular shell such that it is fixedly connected about the perimeter of the drum shell.

The drum utilizes a drumhead that may be formed of natural or synthetic materials. In this regard, a preformed synthetic drumhead may be applied over the open end of the tubular shell. Alternatively, a drumhead may be formed over the open end of the tubular shell utilizing a stretchable material. In one such embodiment, animal skins arc utilized to form the drumhead. Such animal skin drumheads maybe made of any skin that exhibits the necessary qualities to withstand tensioning and percussive striking including, without limitation, goat skin, cow hide, fish skins, etc. Typically, such skin drumheads will have a thickness between about 0.3 mm an about 2mm. In any case, the drumhead will be interconnected directly to the outside surface of the tubular shell. Preferably, the contact region between the drumhead and the outside surface of the tubular shell will at least partially overlap the contact area between the reinforcing annular member and the tubular shell. That is the contact regions will preferably be at least partially concentric.

In one embodiment, the drumhead is interconnected in a substantially continuous manner about the outside surface of the tubular member. In this regard, the drumhead may be interconnected utilizing mechanical fasteners (e.g., tacks, screws, staples etc.) or utilizing an adhesive. As will be appreciated, utilization of an adhesive allows for continuous interconnection of the drumhead around the outside surface of the tubular shell, which may allow for enhanced tensioning of the drumhead.

Various adaptations may be made to the simplified drum of the first aspect. For example, the drum may be converted into a cuica-type instrument where a flexible string or rigid elongate member (e.g. a stick) is interconnected to the portion of the drumhead extending over the open end of the drum shell. This string or rigid member is utilized to transfer vibrations along its length to the drumhead, which in turn vibrates producing musical tones. For example, a string interconnected to a stop (e.g., a circular button) may pass through an aperture within the drumhead that is sized to prevent the stop from passing through. The string may then be tensioned (e.g., pulled taut through the drum shell) such that additional tension is applied to the drumhead. Accordingly, this string may be rubbed or plucked to produce vibrations within the drumhead.

According to a second aspect of the present invention, a method of constructing a hand drum is provided. The method includes the steps of applying an adhesive to the outside surface of a tubular shell and more preferably applying the adhesive continuously around the shell's outside surface adjacent to an open end of the shell. Next, a stretchable drumhead is disposed over the open end of the tubular shell and clamped about the tubular shell using a resilient clamp. In this regard, the periphery of the stretchable drumhead is compressed into the adhesive on the outside surface of the tubular shell. At this point, the drumhead may be tensioned by stretching the drumhead over the edges of the tubular shell. In this regard, any excess drumhead material may be pulled over the rim of the shell and past/beneath the resilient clamp. That is, the resilient clamp allows drumhead material to be pulled by the clamp, but does not allow the drumhead to relax after tensioning. Once a drumhead is properly tensioned, excess adhesive may be removed (i.e., if necessary) and the adhesive may be cured while the resilient clamp is in place. Once the adhesive is fully cured, the resilient clamp is removed and any excess drumhead not adhered to the outside surface of the tubular shell may be removed.

The step of tensioning may entail pulling on opposing peripheral edges of the drumhead that extend beneath the resilient clamp around the outside surface of the tubular shell. Furthermore, to properly tension the drumhead opposing peripheral edges may be tensioned in a sequential manner around the outside perimeter of the tubular shell. For example, opposing peripheral edges of the drumhead may be tensioned in a star pattern such that the drumhead is evenly tensioned over the open end of the tubular shell.

In one embodiment, the method utilizes a stretchable skin drumhead. In this embodiment, the method will further comprise the step of saturating the skin drumhead prior to disposing the drumhead over the open end of the tubular shell. That is, the drumhead is saturated such that it may be stretched for tensioning purposes. Furthermore, when utilizing a skin drumhead, the method will further include drying the skin drumhead to further tension the drum. In this regard, the skin drumhead is initially tensioned (e.g. stretched) a desired amount then allowed to dry. As will be appreciated, as the skin drumhead dries, it will continue to tension the drum. To allow for even drying of the drumhead, a wet cloth may be placed over the drumhead during the drying process.

Utilization of a saturated skin drumhead that shrinks upon drying allows for producing a drum that has a highly tensioned drumhead as is typically required for a musical quality drum. However, the shrinking drumhead also applies enhanced compressive forces across the open end of the tubular shell. In order to withstand these enhanced forces, the method may further comprise the step of interconnecting an annular reinforcing member within the open end of the tubular shell. As in the first aspect of the present invention, the annular member is utilized to increase the hoop strength of the tubular shell. Again, this annular reinforcing member may be interconnected to the inside surface of the shell in any appropriate manner including, without limitation, utilizing mechanical fasteners and/or adhering. In any case, the end surface of the annular member and the tubular shell are preferably aligned to be substantially flush.

As noted, clamping the drumhead to the tubular shell utilizing a resilient clamp allows the drumhead material to be pulled by the clamp during the tensioning step. In this regard, the resilient clamp should allow the drumhead to be pulled on the clamp while maintaining a sufficient clamping force to prevent the drumhead from relaxing after tensioning. In one embodiment, elastic bands (e.g., rubber bands) are utilized to clamp the drumhead around the tubular shell. As will be appreciated, one or more rubber bands may be utilized for the clamping step. However, other resilient clamping means may be utilized such as, for example, straps, rigid rings (e.g., metal, wood, etc) and/or otherwise adjustable hoops.

DETAILED DESCRIPTION

The present invention is directed towards a musician quality hand drum having a simplified construction that allows the drum to be manufactured at a low cost. In the embodiment described below, the hand drum utilizes an animal skin drumhead that is adhered directly to the drum shell, eliminating the use of complex and expensive tensioning devices. In order to tension the skin drumhead to a desired amount, the drumhead is applied in a wet condition, stretched, secured to the outside perimeter of the drum shell and allowed to dry. As will be appreciated, upon drying the drumhead becomes taut. Furthermore, in the embodiment described herein, the drum shell is a lightweight low cost shell, which in order to withstand the forces applied by the tensioned drumhead and percussive striking of the drumhead, utilizes a simplified internal reinforcing ring. In a further embodiment discussed below, the hand drum of the present invention may be manufactured by the purchaser of a kit, allowing for further cost savings. However, it will be appreciated that certain aspects of the present invention are not limited to such embodiments.

Figure 1:
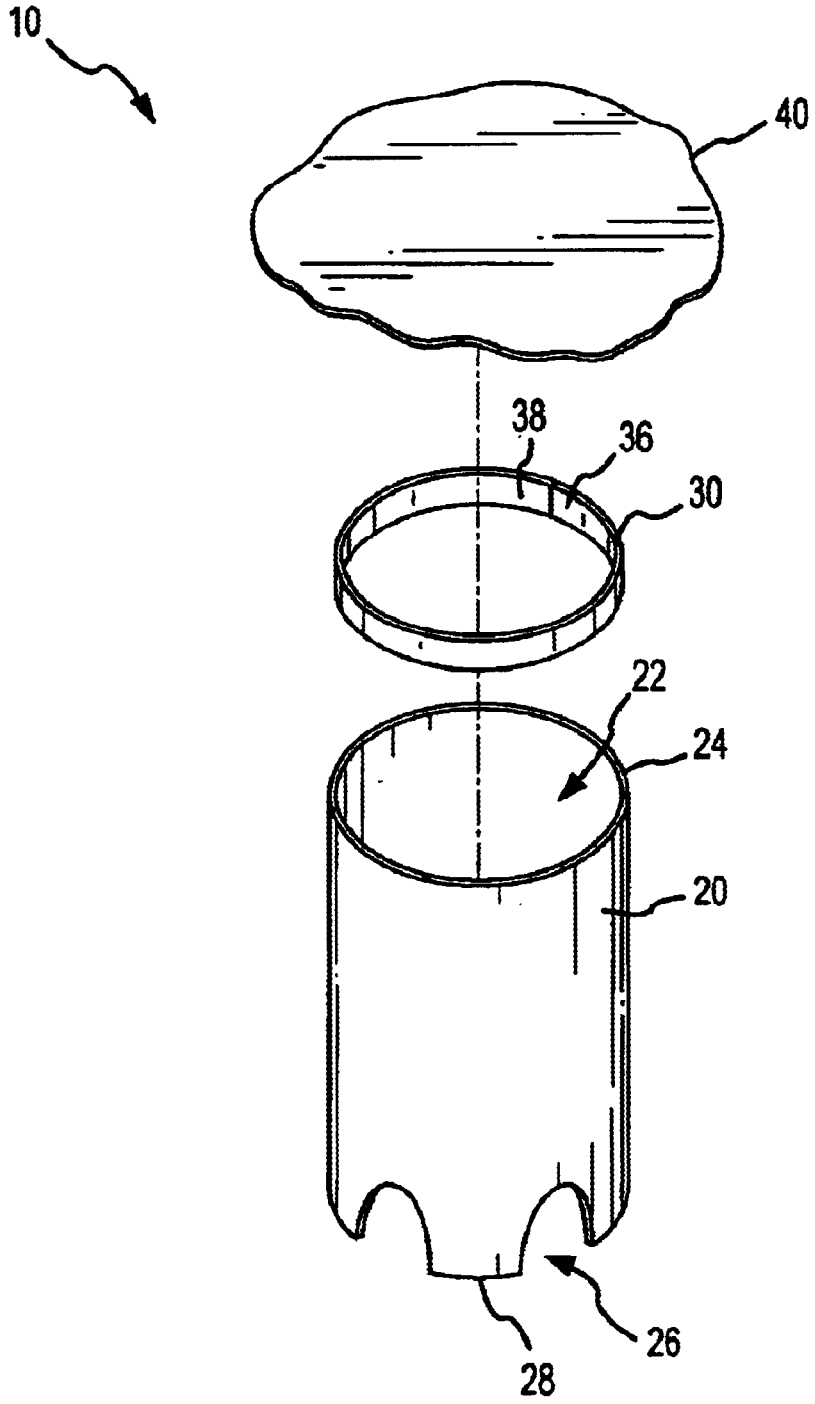
FIG. 1 shows an exploded perspective view of the present invention.

FIG. 1 shows an exploded perspective view of a hand drum 10 of the present invention. As shown, the drum 10 includes three major components: a drum shell 20, a reinforcing ring 30, and a drumhead 40. Upon assembly, the reinforcing ring 30 is interconnected about the inside perimeter of the drum shell 20 and the drumhead 40 is disposed over the end of the drum shell 20 and interconnected to the outside perimeter of the drum shell 20, as will be more fully discussed herein. Though discussed herein as utilizing a single drumhead 40 covering the top open end 22 of the drum shell 20, it will be appreciated that the bottom open end of the drum shell 20 may be also covered by a drumhead 40 in accordance with the procedures described herein below.

The drum shell 20 is a substantially cylindrical tube having top and bottom open ends 22, 26. The top end 22 of the drum shell 20 is covered by the drunhead 40 producing a hand drum 10 known variously as a conga or bongo. The length and the diameter of the drum shell 20 may be selected to provide desired tonal sounds. For example, two drums 10 having identical diameters may produce different tones if the length of their drum shells 20 are different. In this regard, the shorter drum will typically produce a sound having a higher tone while the longer drum 10 will produce a lower tone. Likewise, a drum having a smaller shell diameter will have a higher tone than a drum having the same length but a larger shell diameter. In the embodiment shown, the drum shell is between about 1 and 3 feet in length, allowing for a user to play the drum in the sitting position. That is, the drum 10 is designed to be held between a user's knees while in a sitting position (e.g., in a chair).

The bottom open end 26 of the drum 10 includes several cutouts 50. These cutouts 5 define legs 28 of the drum 10. Utilization of these cutouts 50 allows the drum 10 to produce full volume while a user is in a sitting position. In this regard, the drum 10 does not require a stand (e.g., to hold the open bottom end 26 above the floor), nor does it have to be tilted to produce a desired tone. As may be appreciated, the shape of these cutouts may be varied to affect the tone of the drum 10. For example, the cutouts may extend further along the sidewall of the drum shell 20 to alter the tone of the drum 10. Alternatively, the drum 10 may be formed without the cutout 50 and played in a normal fashion (e.g., using a stand or tilting the drum 10).

In the embodiment shown in FIG. 1, the drum shell 20 is formed of a cellulose fiber material (e.g., a dense cardboard). In this regard, the drum shell 20 is inexpensive to manufacture, lightweight in comparison with a laminate shell, and provides a surface well suited for interconnecting the reinforcing ring 30 and drumhead 40. Utilization of a cellulose fiber drum shell also provides a surface well adapted to receiving paint (e.g. a porous surface) allowing for decoration of the drum 10. However, it will be appreciated that alternate materials, such as sheet metal and wood, may be utilized to form the drum shell 20.

As noted, the drum shell 20 may come in a variety of diameters. Likewise, the thickness of the drum shell may be varied. In this regard, the cellulose fiber drum shell may have a wall thickness between about three sixteenths of an inch and about one inch. As will be appreciated, utilization of a thicker wall drum shell 20 allows the drum shell 20 to support greater inward stress as applied by the drumhead 40 and percussive striking. However, this added structural integrity of the drum shell 20 results in a heavier, more cumbersome drum 10. Accordingly, it has been found that a wall thickness of about three sixteenths of an inch provides a durable drum shell 20 having good tonal characteristics without resulting in a cumbersome, heavy drum. However, utilization of this wall thickness results in a drum shell 20 that is not self-supporting. That is, the top open end 22 of the drum shell 20 does not have the hoop strength to withstand the stresses applied by the drumhead 40 and/or percussive striking. Accordingly, the reinforcing ring 30 is inserted within the top open end 22 of the drum shell 20 to prevent distortion of the drum 10.

Figure 2:
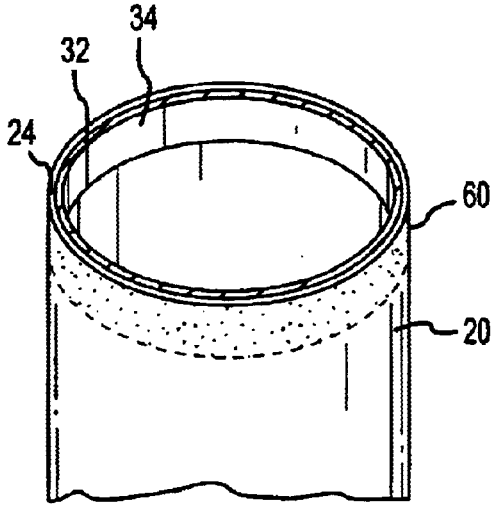
FIG. 2 shows a perspective view of a reinforcing ring and shell of the present invention.
Figure 3:
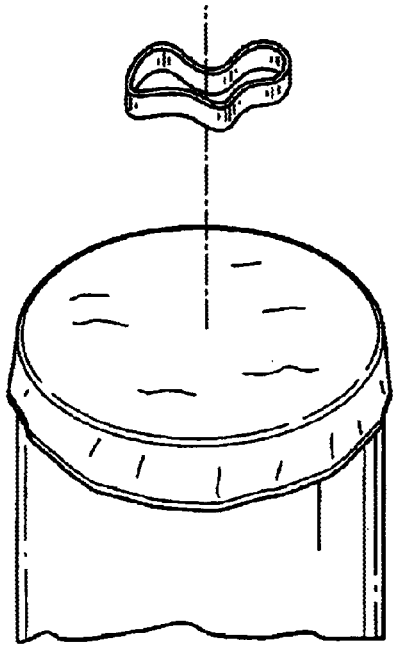
FIG. 3 shows a perspective view of a non-tensioned drumhead disposed on top of the shell.

As shown in FIGS. 1 and 2, the reinforcing ring 30 is sized to be matingly received within the top open end 22 of the drum shell 20. That is, the outside diameter of the reinforcing ring 30 is substantially equal to the inside diameter of the drum shell 20. The reinforcing ring 30 is formed such that its hoop strength is greater than the hoop strength of the drum shell 20. In this regard, upon being inserted within the top open end 22 of the drum shell 20, the percussive end of the drum 10 is able to bear greater forces as applied by the drumhead 40 and/or percussive striking without distortion. As will be appreciated, the exact material and physical characteristics of the reinforcing ring 30 may be varied depending on its expected use. For example, drums 10 having larger diameters may utilize reinforcing rings having a sidewall thickness 34 larger than that utilized for smaller diameter drums. Likewise, less structurally robust rings (e.g. thinner) may be utilized when smaller forces are expected.

The reinforcing ring 30 will typically have a sidewall 34 of a length sufficient to extend into the drum shell 20 a distance equal to or greater than the length about the outside perimeter of the drum shell 20 to which the drumhead 40 will be interconnected, as will be discussed herein. The reinforcing ring 30 may include a mechanical adjuster that allows the tension of the reinforcing ring and thereby the drumhead 40 to be adjusted. However, in the embodiment shown, the reinforcing ring 30 utilizes no adjuster and is formed from a substantially circular member having first and second free ends 36, 38. The free ends 36, 38 of the reinforcing ring 30 are in an abutting relationship when disposed within the drum shell 20 such that the reinforcing ring 30 has a hoop strength similar to a continuous ring. In one embodiment, the reinforcing ring 30 is formed from a PVC tube which is adhered within the drum shell 20. Accordingly, this provides a cost efficient reinforcing ring 30.

The drumhead 40 utilized with the present drum is a natural skin membrane. As noted above, natural skins are often preferred over synthetic materials as many musicians believe they produce superior sounds. Furthermore, for the present embodiment, the animal skin drumhead 40 provides an additional important benefit, namely, the ability to stretch and shrink upon wetting and drying, respectively. In this regard, the drumhead 40 is initially saturated with water, stretched over the outside perimeter of the top end 22 of the drum shell 20, adhered in place and allowed to dry. As the skin dries, it is additionally tautened, thereby producing a highly tensioned drumhead 40. In this regard, a drum 10 may be formed with a high quality natural skin drumhead 40 in an economical manner. Typically, these skins will have a thickness of between about 0.5 mm and about 2 mm. Additionally, the use of a skin drumhead allows the drumhead 40 to be decorated. That is, the skin drumhead 40 is a porous surface that may be stained dyed or otherwise permanently marked. For example, prior to applying the drumhead 40 to the drum shell 20, the drumhead 40 may be tie dyed to create an individualize look for the resulting drum 10.

Figure 6:
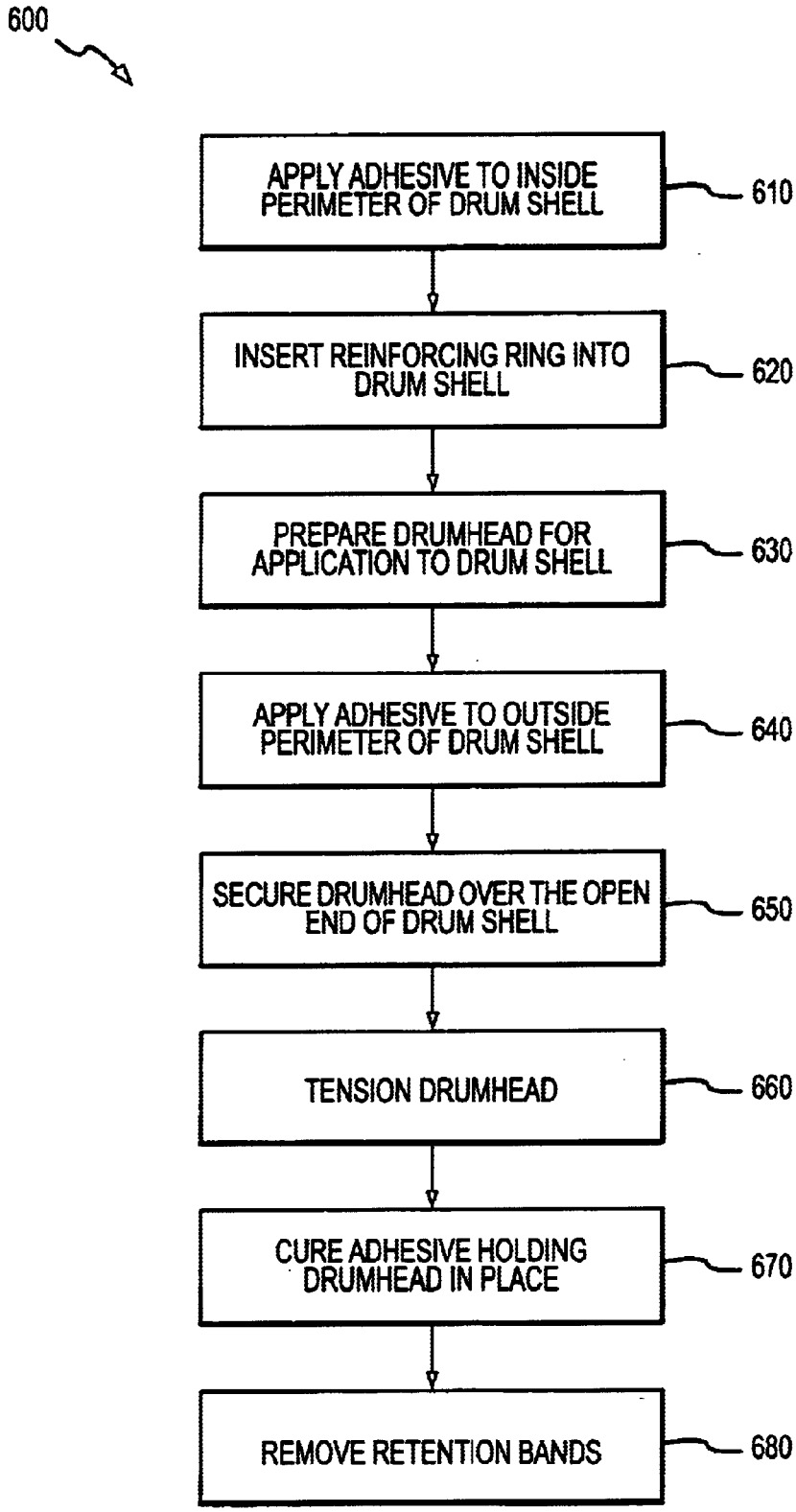
FIG. 6 shows a process flow chart for producing the drum.

In order to further reduce the cost of the drum 10 described above, the drum may come in a kit form allowing a user to assemble the drum. In this regard, the kit may include the drum shell 20, the reinforcing ring 30, the drumhead 40, an adhesive agent 60, retention bands 70 and instructions for assembling the drum 10. FIG. 6 depicts the steps of a method (600) utilized to produce the drum 10 described hereinabove. Initially, adhesive agent 60 may be applied (610) to the inside perimeter of the top open end 22 of the drum shell 20. In this regard, the adhesive agent should be applied (610) to a band about the inside perimeter of the drum shell 20 substantially equal in length to the sidewall 34 of the reinforcing ring 30. Alternatively, the adhesive agent 60 may be applied to the outside sidewall 34 of the reinforcing ring 30. Once the adhesive agent is applied (610), the reinforcing ring is inserted (620) into the open end of the drum shell 20. See FIG. 2. In this regard, the top edge 32 of the reinforcing ring 30 may be disposed within the drum shell 20 slightly recessed relative to the top edge of the drum shell 20 to prevent the reinforcing ring 30 from contacting the drumhead 40 when the drum 10 is played. Altenatively, the reinforcing ring 30 may interconnected within the drum shell 20 prior to being delivered to a consumer.

Once the adhesive agent 60 utilized to adhere the reinforcing ring 30 within the drum shell 20 has cured, the drumhead 40 may be applied to the drum 10. As will be appreciated, the natural skin drumhead 40 (e.g., goatskin) will initially be in a dried form. Prior to attachment to the drum 10 and the skin, the drumhead 40 must be prepared (630) for application. Preparation (630) includes soaking the drumhead 40 in water. In this regard, the drumhead 40 should be fully submerged in water to ensure even wetting. Furthermore, it should be noted that excessive soaking of the natural skin drumhead 40 may deteriorate the skin. Accordingly, care should be taken not to over soak the drumhead 40. Once the drumhead 40 is fully saturated, it is removed from the water and lightly compressed between two towels to remove excess water. At this time, an adhesive agent may be applied (640) to the outside perimeter of the top open end 22 of the drum shell 20. Preferably, the outside surface of the drum shell 20 will have been previously painted or otherwise marked to facilitate application of the adhesive agent 60 along a band having a continuous width about the perimeter of the drum shell 20.

Figure 4:
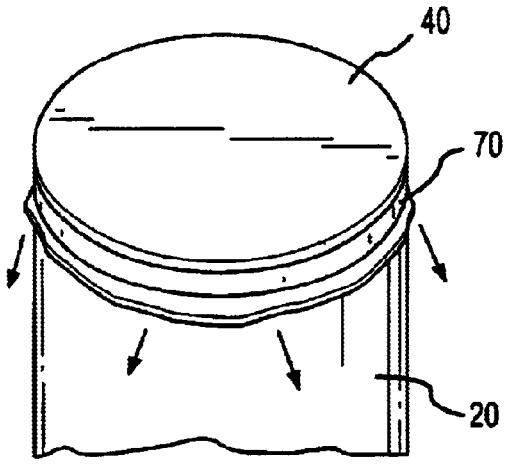
FIG. 4 is a perspective view of applying tension to the drunhead.
Figure 5:
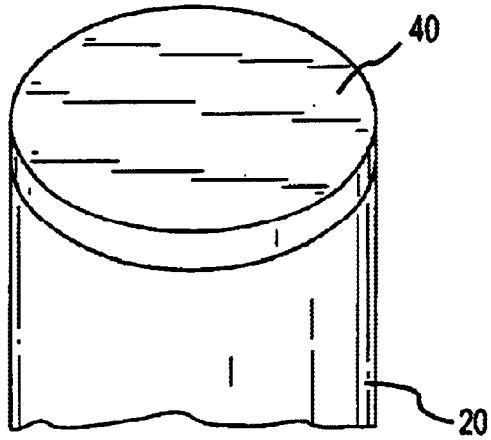
FIG. 5 shows a perspective view of the final product.

Once the adhesive is applied (640), the saturated drumhead 40 is secured (650) over the open end of the drum 10. Of note, the hair follicle side of the skin should be disposed upward. Securing entails applying at least a first elastic retention band 70 (e.g., a rubber band) over the drumhead 40 and around the drum shell 20. Any wrinkles in the drumhead 40 may then be removed by gently pulling on the excess drumhead 40 disposed below the elastic retention band 70 (see FIG. 4). Once all the wrinkles are removed from the drumhead 40, the first elastic retention band 70 may be positioned such that its top edge is aligned with the top of the drum shell 20. At this time, a second elastic retention band 70 may be disposed around the drum shell 20 and positioned directly below the first retention band 70. As will be appreciated, utilization of two elastic retention bands 70 allows for an increased holding force between the drumhead 40 and the drum shell 20.

Once secured (650) to the open end of the drum shell 20, the drumhead 40 is tensioned (660) by pulling evenly and firmly at opposite sides of the drumhead 40 (i.e., by pulling on the excess drumhead 40 below the elastic retention bands 70). The drunhead 40 is tensioned (660) by pulling on opposite sides of the drumhead 40 at multiple positions around the drum shell 20 (e.g., in a star pattern) until the drumhead 40 is pulled tight and wrinkle free. The drumhead 40 is taut enough if, upon tapping the center of the drumhead

40, vibrations stop within one second. However, as will be appreciated, the drumhead 40 more firmly tensioned or less firmly tensioned to adjust the resulting tone of the drum 20.

Once the drumhead is tensioned (660) to a desired amount, the first and second retention bands 70 are adjusted, if necessary, such that a first band is even with the top of the drum 10, the second band is aligned with the first band. Any excess glue around the drum under the loose flap of drumhead extending beneath the second elastic retention band 70 may be removed utilizing a damp paper towel. Care should be taken not to press down on the drumhead during this step. At this time, the adhesive is cured (670) while drumhead 40 is allowed to dry. To allow even drying of the drumhead 40 a damp washcloth is laid across the top of the drumhead 40. Once the drumhead 40 is dry, a utility knife may be utilized to cut and remove excess drumhead 40 below the elastic bands 70 which are not adhered to the drum shell 20. Accordingly, the elastic retention bands 70 may then be removed (680). At this point, the drum 10 is formed. However, as will be appreciated, the length of the drum shell may be adjusted to change the tone of the drum 10. That is, the drum may be cut to a desired length to affect its tone. Likewise, cutouts may be made within the drum shell in order to create the legs 28 and further alter the tone of the drum. Finally, the surface of the drum shell may be decorated to individualize the finished product.

The embodiments described above are for exemplary purposes only and are not intended to limit the scope of the present invention. Various adaptations, modifications and extensions of the described hand drum will be apparent to those skilled in the art and are intended to be within the scope of the invention as defined by the claims which follow. By way of example, the drum described above may be modified to form a cuica. That is, the drum may be modified such that a stick or string is attached to the middle of the drumhead, which may be tensioned against/away from the drumhead and rubbed by the player with a piece of damp cloth or cotton. The friction on the stick or string causes the head of the cuica to vibrate and "squeak". Accordingly, the pitch of the cuica can be changed by altering the tension of the string/stick relative to the drumhead. Likewise, a string attached to or extending through the drumhead may be tensioned and plucked to produce a combination string and percussive instrument.

What is claimed is:

1. A hand drum, comprising:

a tubular shell having an inside surface, an outside surface and a first open end;

an annular reinforcing member interconnected directly to the inside surface of the tubular shell substantially adjacent to the first open end, wherein the annular reinforcing member includes first and second free ends disposed in abutting relationship when interconnected to the inside surface of the tubular shell;

a stretchable drumhead extending across the first open end of the tubular shell and being directly interconnected in tension to the outside surface of the tubular shell.

2. The drum of claim 1, wherein a first contact region between the annular reinforcing member and the tubular shell and a second contact region between the drumhead and the tubular shell are at least partially concentric.

3. The drum of claim 1, wherein the annular reinforcing member has a hoop strength greater than the hoop strength of the tubular shell.

4. The drum of claim 3, wherein the annular reinforcing member has a continuous sidewall forming an aperture.

5. The drum of claim 1, wherein said annular reinforcing member is interconneted in a substantially continuous manner about the inside surface of the tubular shell.

6. The drum of claim 5, wherein the annular reinforcing member is adhered to the inside surface of the tubular shell.

7. The drum of claim 1, wherein an end surface of the annular reinforcing member is recessed relative to an end surface of the tubular shell.

8. The drum of claim 1, wherein the stretchable drumhead comprises a skin drumhead.

9. The drum of claim 8, wherein the skin drumhead has a thickness between about 0.5 mm and about 2 mm.

10. The drum of claim 8, wherein the skin drumhead is interconnected to the outside surface of the tubular shell in a saturated condition, wherein the skin drumhead becomes taut upon drying.

11. The drum of claim 1, wherein the drumhead is interconnected in a substantially continuous manner around the outside surface of the tubular member.

12. The drum of claim 11, wherein the drumhead is adhered directly to the outside surface of the tubular shell.

13. The drum of claim 1, wherein the tubular shell is substantially cylindrical.

14. The drum of claim 13, wherein the annular reinforcing member has an outside diameter substantially equal to an inside diameter of the substantially cylindrical shell.

15. The drum of claim 1, wherein the tubular shell is made of a cellulose fiber.

16. The drum of claim 15, wherein the tubular shell has a sidewall thickness between about 3/16 of an inch and about 1 inch.

17. The drum of claim 1, wherein the tubular shell has a sidewall length between about one foot and about three feet.

18. A method for constructing a hand drum, comprising the steps of:

applying adhesive to the outside surface of a tubular shell relative to an open end of the tubular shell;

disposing a stretchable drumhead over the open end of the tubular shell;

clamping the drumhead and around the outside surface of the tubular shell using a resilient clamp, wherein a periphery of the drumhead is compressed into the adhesive on the outside surface of the tubular shell;

tensioning the drumhead;

curing the adhesive while the drunhead is tensioned; and removing the resilient clamp.

19. The method of claim 18, wherein tensioning comprises stretching the drumhead while the periphery of the drumhead is resiliently clamped around the outside surface of the tubular shell.

20. The method of claim 18, wherein stretching pulling opposing peripheral edges of the drumhead extending beneath the resilient clamp, wherein excess drumhead material is pulled by the resilient clamp.

21. The method of claim 20, wherein stretching comprises pulling a plurality of opposing peripheral edges about a perimeter of the tubular shell.

22. The method of claim 18, further comprising the step of:

prior to applying the adhesive to the outside surface of the tubular member, interconnecting an annular reinforcing member around the inside surface of the tubular shell substantially adjacent to the open end of the tubular shell.

23. The method of claim 22, wherein interconnecting comprises adhesively interconnecting the annular member around the inside surface of the tubular shell.

24. The method of claim 22, wherein interconnecting comprises interconnecting the annular member within the inside surface of the tubular shell such that it will be at least partially concentric with the periphery of the drumhead attached to the outside surface of the tubular shell.

25. The method of claim 18, wherein clamping comprises stretching an elastic band around the outside perimeter of the tubular shell.

26. A method for reinforcing a drum shell, comprising:

disposing a ring member within the open end of a tubular shell wherein first and second free ends of the ring member are disposed in an abutting relationship;

first interconnecting the ring member directly to the inside surface of the tubular shell;

stretching a drumhead over the open end of the tubular shell;

second interconnecting the drumhead directly to the outside surface of the tubular shell;

wherein a first contact region between the ring member and the tubular shell and a second contact region between the drunhead and the tubular shell are at least partially concentric.

27. The method of claim 26, wherein disposing further comprises:

conforming the ring member to the inside surface of the tubular shell substantially adjacent to the open end of the tubular shell.

28. The method of claim 26, wherein the first interconnecting step comprises continuously interconnecting the ring member about an inside perimeter of the tubular shell.

29. The method of claim 28, wherein the first interconnecting step comprises adhering the ring member directly to the tubular shell.

30. The method of claim 26, wherein the second interconnecting step comprises continuously interconnecting the drumhead about an outside perimeter of the tubular shell.

31. The method of claim 30, wherein the second interconnecting step comprises adhering the drumhead directly to the tubular shell.

* * * * *

UNITED STATES PATENT AND TRADEMARK OFFICE

CERTIFICATE OF CORRECTION

PATENT NO. : 6,909,040 B1
DATED : June 21, 2005
INVENTOR(S) : Frederickson et al.

It is certified that error appears in the above-identified patent and that said Letters Patent is hereby corrected as shown below:

Column 2,
Line 22, delete “drunhead,” and insert therefor -- drumhead --.

Column 5,
Line 40, delete “drunhead,” and insert therefor -- drumhead --.

Column 6,
Line 15, delete “drunhead,” and insert therefor -- drumhead --.

Column 8,
Line 18, delete “Altenatively,” and insert therefor -- Alternatively --;
Line 63, delete “drunhead,” and insert therefor -- drumhead --.

Column 10,
Line 2, delete “interconneted,” and insert therefor -- interconnected --;
Line 45, delete “drunhead,” and insert therefor -- drumhead --.

Column 12,
Line 1, delete “drunhead,” and insert therefor -- drumhead --.

Signed and Sealed this

Sixth Day of September, 2005

JON W. DUDAS
*Director of the United States Patent and Trademark Office*